US007771540B2

(12) United States Patent
Schwartz

(10) Patent No.: US 7,771,540 B2
(45) Date of Patent: Aug. 10, 2010

(54) SYSTEM FOR CLEANING DENTAL AND/OR MEDICAL APPLIANCES AND IMPLEMENTS UTILIZING A SONIC WAVE BATH

(75) Inventor: Dann A. Schwartz, Metairie, LA (US)

(73) Assignee: Raintree Essix

( * ) Notice: Subject to any disclaimer, the term of this patent is extended or adjusted under 35 U.S.C. 154(b) by 1008 days.

(21) Appl. No.: 11/048,165

(22) Filed: Feb. 1, 2005

(65) Prior Publication Data

US 2005/0194022 A1 Sep. 8, 2005

Related U.S. Application Data

(60) Provisional application No. 60/551,194, filed on Mar. 8, 2004.

(51) Int. Cl.
*B08B 3/12* (2006.01)

(52) U.S. Cl. ..... 134/1; 134/42

(58) Field of Classification Search ..... 134/1, 134/2, 25.4, 34, 42

See application file for complete search history.

(56) References Cited

U.S. PATENT DOCUMENTS

| | | | | | |
|---|---|---|---|---|---|
| 3,254,284 | A * | 5/1966 | Tomes | 318/118 |
| 3,607,759 | A * | 9/1971 | Barth | 510/100 |
| 3,822,212 | A * | 7/1974 | Bryant et al. | 510/116 |
| 4,272,393 | A * | 6/1981 | Gergely | 134/2 |
| 4,406,708 | A * | 9/1983 | Hesselgren | 134/37 |
| 4,511,486 | A * | 4/1985 | Shah | 134/42 |
| 4,753,792 | A * | 6/1988 | Aberg | 424/44 |
| 4,806,173 | A * | 2/1989 | Toukan | 134/42 |
| 4,903,718 | A * | 2/1990 | Sullivan | 134/184 |
| 5,015,408 | A * | 5/1991 | Reuss | 510/100 |
| 5,736,158 | A * | 4/1998 | Quast | 424/464 |
| 5,980,641 | A * | 11/1999 | Jakubowski | 134/1 |
| 6,121,215 | A * | 9/2000 | Rau | 510/130 |
| 6,468,950 | B1 * | 10/2002 | Kawasaki et al. | 510/116 |
| 2002/0096189 | A1 * | 7/2002 | Kume | 134/1.3 |
| 2003/0062062 | A1 * | 4/2003 | Tricca | 134/1 |
| 2004/0118427 | A1 * | 6/2004 | Palfy et al. | 134/1 |

FOREIGN PATENT DOCUMENTS

| | | | |
|---|---|---|---|
| GB | 2090855 | A * | 7/1982 |
| RU | 2252730 | C2 * | 5/2005 |

* cited by examiner

*Primary Examiner*—Michael Kornakov
*Assistant Examiner*—Eric Golightly
(74) *Attorney, Agent, or Firm*—Joseph T Regard Ltd plc

(57) ABSTRACT

A cleaning apparatus and method for cleaning dental and/or medical implements, and in particular to a system for quickly and thoroughly cleaning dental and/or orthodontic retainers, dental/orthodontic aligners, dental appliances, dentures, bridges, and the like. The preferred embodiment of the present invention contemplates a cleaning system utilizing a vibrating sonic wave bath comprising a vibration means to oscillate a container having at least some fluid therein engaging the item to be cleaned, coupled with the utilization of a preferably flavored tablet containing a non-toxic cleaning material, the tablet preferably also formulated to effervesce upon contact with water, generating bubbles and foam. It has been found that the sonic bath substantially enhances the cleaning and flavoring ability of the effervescent cleaning tablet, while reducing the amount of time to clean the dental appliance. The preferred embodiment of the present invention provides a relatively cost effective, safe, easy to use and reliable system for cleaning and flavoring dental appliances and the like.

21 Claims, 1 Drawing Sheet

SYSTEM FOR CLEANING DENTAL AND/OR MEDICAL APPLIANCES AND IMPLEMENTS UTILIZING A SONIC WAVE BATH

PRIORITY CLAIM

This Application claims the benefit of Provisional Patent Application Ser. No. 60/551,194, filed Mar. 8, 2004.

TECHNICAL FIELD of the INVENTION

The present invention relates to cleaning apparatus and method for cleaning, disinfecting, and/or flavoring dental and/or medical implements, and in particular to a system for quickly and thoroughly cleaning dental and/or orthodontic retainers, dental/orthodontic aligners, dental appliances, dentures, bridges, and the like.

The preferred embodiment of the present invention contemplates a cleaning system utilizing a vibrating sonic wave bath comprising a vibration means to oscillate a container having at least some fluid therein engaging the item to be cleaned, coupled with the utilization of a preferably flavored tablet containing a non-toxic cleaning material, the tablet preferably also formulated to effervesce upon contact with water, generating bubbles and foam.

It has been found that the sonic bath substantially enhances the cleaning and flavoring ability of the effervescent cleaning tablet, while reducing the amount of time to clean the dental appliance.

The preferred embodiment of the present invention provides a relatively cost effective, safe, easy to use and reliable system for cleaning and flavoring dental appliances and the like.

BACKGROUND OF THE INVENTION

Sonic cleaners have been utilized in the jewelry trade and other applications, and have in the past utilized specially formulated cleaning fluids to facilitate non-damaging cleaning of the items therein.

Effervescent tablets are believed to have been traditionally utilized in static fluid environments, such as, for example, a glass of water, to provide a means of dispensing medication or flavoring into the water for consumption by a user, or in a cleaning capacity, wherein the tablet is formulated with a cleaning agent and to effervesce upon contact with a fluid bath, the effervescence generating bubbles which disperses the cleaning agent in the fluid.

A shortcoming of the use of effervescent tablets is that, while the bubbles may assist to some degree in the cleaning process, it is the cleaning formulation which is most responsible for the cleaning, and the bubbles primarily serve to disperse the cleaning agent. It is for this reason that it is generally recommended that the items being cleaned are required to soak in the fluid bath for a considerable time after the tablet(s) have fully dissolved, and the effervescence has ceased.

Further, the effervescence generally provides insufficient scrubbing action, and often it is recommended that the items be brushed after cleaning to finish cleaning the item.

GENERAL SUMMARY DISCUSSION OF THE INVENTION

Unlike the prior art, the present invention provides a system for cleaning dental appliances, implements or the like which is effective, safe, and cost effective, overcoming the shortcomings associated with the sole use of the sonic bath or effervescent tablet methods.

The system of the present invention utilizes a unobvious combination of prior art components to produce an enhanced cleaning system, wherein there is provided a vibrating sonic wave bath comprising a vibration means to oscillate a container having at least some fluid therein engaging the item to be cleaned, coupled with the utilization of a preferably flavored tablet containing a non-toxic cleaning material, the tablet preferably also formulated to effervesce upon contact with water, generating bubbles and foam.

The present invention resulted upon a discovery that certain sonic baths substantially enhance the cleaning and flavoring ability of the effervescent cleaning tablet, while substantially reducing the amount of time to clean the item, particularly when the present system is utilized to clean, disinfect and flavor dental appliances or the like.

Where prior art systems may have taken hours to clean, disinfect, and flavor an item utilizing the old static bath with short term effervescence generated by the tablet, it has been found that utilizing the system of the present invention only five to ten minutes effectively accomplishes the task of cleaning, disinfecting and flavoring a dental appliance or the like.

Accordingly, a sonic bath is provided which is configured to contain a fluid, wherein there is deposited the aligner and a flavoring/cleaning and or disinfecting effervescent tablet, at which time the sonic bath is initiated to enhance the formation of bubbles and foam by the tablet, which has been found to greatly increase the scrubbing action of said bubbles/foam, reducing or eliminating all together the need for subsequent brushing of the appliance.

Further, the sonic action allows greater penetration of the flavoring into the thermoplastic forming the appliance, within a substantially decreased time when compared to prior art methods.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
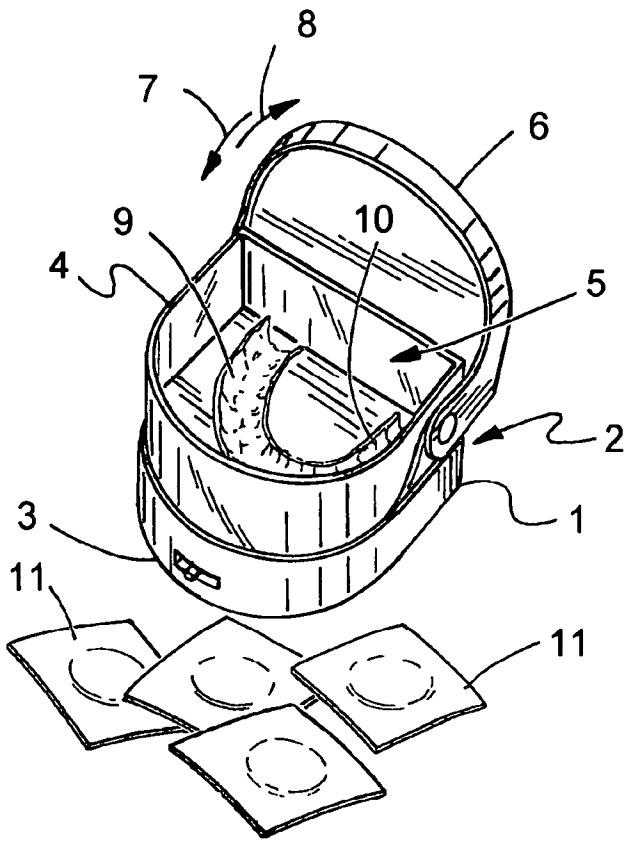
FIG. 1 is an upper, isometric view of the system of the present invention, illustrating a sonic cleaner having a cleaning tray having a dental appliance therein.

Referring to FIG. 1, the preferred embodiment of the present invention contemplates utilizing a sonic cleaning device 1 such as the cordless sonic cleaner item model RB-USC sold by Raintree Essix, L.L.C. of Metairie, La. USA, to clean and flavor medical or dental appliance(s) or instrument (s), such as, for example, a wearable, removable dental appliance 9, for example, aligner 10.

As shown, the cleaner 1 preferably is battery 2 powered for portability (although in an alternative embodiment, it could be designed to be plugged in via an AC adapter), and is actuated by a switch 3, which can be fully manual or, in an alternative embodiment, be set to run for a pre-determined period of time.

The bath tray 4 is configured to be filled with a non-toxic fluid, such as, for example, water or the like. A lid 6 is preferably provided, so as to selectively close 7 or open 8 the bath.

Figure 2:
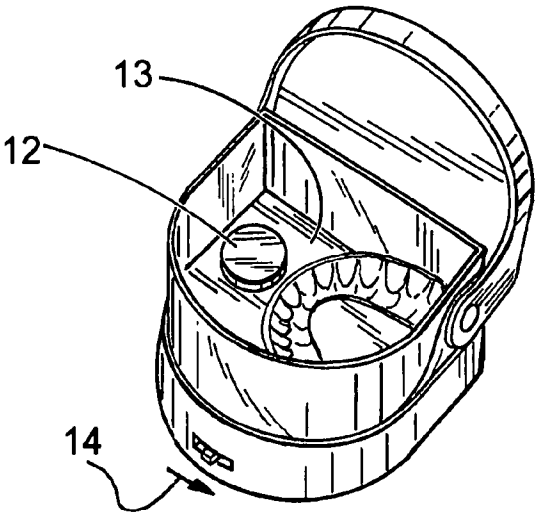
FIG. 2 is an upper, isometric view of the system of FIG. 1, illustrating the effervescent, flavored cleaning tablet in the cleaning tray with the dental appliance.
Figure 3:
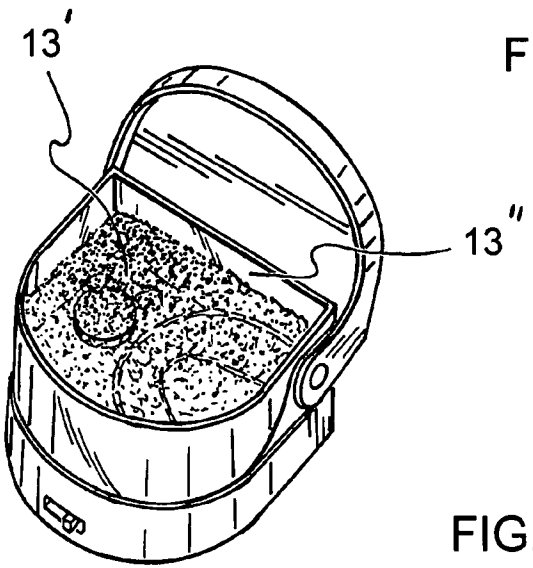
FIG. 3 is an upper, isometric view of the system of FIG. 2, illustrating the effervescent, flavored cleaning tablet effervescing in a sonic bath of water, cleaning and flavoring the dental appliance.

Continuing with FIGS. 1-3, a cleaning and/or flavoring compound in the form of preferably effervescent tablet 12 such as, for example, RETAINER BRITE 11 brand effervescent tablets distributed by Raintree Essix, Inc. of Metairie, La. USA (which can be of various flavors, for example, mint flavor), is placed in the floor 13 of the retainer bath with the appliance 9.

The bath tray is then filled 13'' to the desired level, generally at least enough to activate the effervescent tablet and communicate fluid to the surface of the aligner. The exemplary sonic cleaner is then switched to the on 14 position. In the present example, the bath tray is filled to the desired level with warm water, for example, at a temperature of about 80-100 degrees Fahrenheit.

It is noted that the bath tray can be filled with water to just immerse the tablet in the water, which, when the cleaning device is actuated, generates a foam bath to engage and clean the appliance, or the water can be filled to a level in the bath tray to immerse the appliance, providing predominantly bubbles with less foam in the cleaning action. Also, the water can be filled about half way up the appliance, partially immersing the appliance, thereby providing a combination of bubbles and bubble foam in the cleaning action.

The exemplary sonic cleaner generates about 6,500 vibrations per minute (although 4,000-15000 vibrations per minute, and other frequencies could also provide satisfactory results depending upon the application).

In the present application, the device could be set to generate sonic cleaning action for a timed, predetermined period, for example, five to ten minutes, although the sonic frequency and time of cleaning can vary substantially depending upon the application, and condition of the item being cleaned, as well as the amount of flavoring desired to be infused into the item.

Further, while the sonic cleaner of the present invention emits a relatively steady frequency, in an alternative embodiment, the cleaner can be programmed to vary in frequency to enhance the cleaning application, depending upon the item being cleaned and the degree of cleaning necessary.

Continuing with FIGS. 1-3, upon placing fluid (in the present example, water) into the bath tray and initiating the sonic generator, the effervescent tablet generates cleaning, flavored foam 13' and bubbles, while the sonic waves generated by the sonic cleaner travel through the fluid (water) and foam to urge the bubbles, foam and fluid to provide deep cleaning of the surface of the item to be cleaned, while infusing flavoring in the same.

In the present example, the fluid can fill the bath to fully immerse the appliance to be cleaned, or the fluid can only partially immerse the appliance, which would allow a greater concentration of foam to engage and scrub the appliance during the effervescence and sonic cleaning process.

After cleaning, the aligner 10 or other item which as been cleaned is removed and may be rinsed before use by the user. The bath tray is then cleaned rinsed and ready for the next use.

In the present case, it has been found that the sonic cleaner greatly enhances the effectiveness of the effervescent cleaning tablets. This is believed to occur due to the increased agitation of the bubbles and foam generated by the effervescent tablets.

Where it may have taken hours to clean, disinfect, and flavor the appliance with the old static soak method, utilizing the present system with five to ten minutes of sonic action with the RETAINER BRITE effervescent tablets will effectively clean, disinfect, and impart a mint flavor to the exemplary appliance, a retainer formed of ESSIX brand thermoplastic, supplied by Raintree Essix, L.L.C., of Metairie, La.

Exemplary specifications for the system follow:

Sonic Cleaner:
Height: 7 mm
width: 9 mm
Depth: 8 mm
Bath tray depth: 7¼ mm
Bath tray width: 8 mm
Bath tray height: 4 mm Although the present system is taught as being utilized to clean, disinfect and flavor dental appliances such as aligners, retainers, dentures, bridges, implements, and the like, the disclosure is not intended to be so limiting, and the system can be utilized with other items such as medical implements and the like. Further, while the present invention teaches the utilization of sonic waves, this designation is not to be considered limiting, as it is envisioned that embodiments of the present invention can be satisfactorily utilized with subsonic and ultrasonic waves, depending upon the application.

A summary of the method of the invention disclosed above and herein comprises, for example, a) providing an cleaning device having a bath tray;
b) providing an effervescent cleaning tablet;
c) placing the appliance in the bath tray;
d) placing fluid in said bath tray;
e) placing said effervescent cleaning tablet in said bath tray and fluid;
f) initiating said cleaning device, providing cleaning waves through said bath tray;
g) allowing said effervescent cleaning tablet to effervesce, providing cleaning bubbles and foam;
h) allowing said cleaning waves through said bath tray to agitate said cleaning bubbles and foam, to clean the surface of said appliance.

As indicated, an embodiment of the invention contemplates the use of an effervescent cleaning tablet having a disinfectant, and wherein in there is provided the additional step of allowing said sonic waves to induce said disinfectant to infuse in said appliance, disinfecting said appliance.

As further indicated, an embodiment of the present invention contemplates the use of effervescent cleaning tablet having flavoring and wherein in there is provided the additional step of allowing said sonic waves to induce said flavoring to infuse in said appliance, flavoring said appliance.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A method of cleaning an appliance, comprising the steps of:

a) providing a sonic cleaning device having a bath tray;
b) providing an effervescent cleaning tablet;
c) placing the appliance in the bath tray;
d) placing said effervescent tablet in said bath tray;
e) placing enough fluid in said bath tray so as to activate said effervescent tablet thus, providing foam;
f) initiating said sonic cleaning device to provide cleaning waves through said foam;

g) allowing said foam to substantially contact said appliance so that said appliance is primarily contacted by foam, providing a foam bath; and h) allowing said cleaning waves through said foam bath to agitate bubbles of said cleaning foam, thus providing agitated foam, and utilizing said agitated foam to scrub clean the surface of said appliance.

2. The method of claim 1, wherein there is provided the additional step "h1" of removing, rinsing, and utilizing said appliance.

3. The method of claim 2, wherein said appliance is a dental appliance.

4. The method of claim 3, wherein said dental appliance is an aligner.

5. The method of claim 3, wherein said dental appliance is a retainer.

6. The method of claim 3, wherein said dental appliance is a denture.

7. The method of claim 3, wherein said effervescent cleaning tablet has flavoring and wherein step h comprises allowing said waves to induce said flavoring to infuse in said appliance, thus flavoring said appliance.

8. The method of claim 7, wherein said effervescent cleaning tablet has a disinfectant, and wherein step h comprises allowing said cleaning waves to induce said thus disinfectant to infuse in said appliance, disinfecting said appliance.

9. The method of claim 1, wherein there is further provided in step "h" the additional step "h1" of varying the frequency of said cleaning waves to enhance cleaning of the appliance.

10. A method of flavoring a dental appliance, comprising the steps of:

a) providing a sonic device having a bath tray;

b) providing an effervescent flavored tablet;

c) placing the appliance in the bath tray;

d) placing said effervescent tablet in said bath tray;

e) placing enough fluid in said bath tray so as to activate said effervescent tablet thus, providing flavored foam;

f) initiating said sonic device;

g) allowing said effervescent tablets to effervesce to form a foam bath in said tray substantially covering said dental appliance; and h) allowing sonic waves through said foam bath to agitate said flavored foam, so as to flavor said appliance.

11. The method of claim 10, wherein there is provided the additional step "h1" of removing, rinsing, and utilizing said appliance.

12. The method of claim 11, wherein said dental appliance is an aligner.

13. The method of claim 11, wherein said dental appliance is a retainer.

14. The method of claim 11, wherein said dental appliance is a denture.

15. The method of claim 10, wherein in step "d" only enough fluid to activate said flavored tablet is placed into said bath, so that in step "h" said appliance is primarily contacted by said flavored foam, and wherein in step "h" said appliance is substantially immersed in a foam bath.

16. The method of claim 10, wherein said effervescent cleaning tablet has a disinfectant, and wherein in step h there is provided the additional step of allowing said sonic waves to induce said disinfectant to infuse in said appliance, thus disinfecting said appliance.

17. The method of claim 15, wherein there is further provided in step "h" the additional step "hl" of varying the frequency of said sonic waves to enhance cleaning of the appliance.

18. A method of cleaning a dental appliance, comprising the steps of:

a) providing a sonic device having a bath tray;

b) placing an effervescent tablet in said bath tray;

c) placing the appliance in said bath tray;

d) placing enough fluid to activate said effervescent tablet in said bath tray;

e) initiating said sonic device, providing sonic waves through said fluid to agitate said effervescent tablet;

f) allowing said effervescent tablet to effervesce, thus providing foam; and g) allowing said sonic waves through said fluid to agitate said foam, providing an agitated foam bath substantially covering said dental appliance, and utilizing said agitated foam bath to scrub clean said appliance.

19. The method of claim 18, wherein there is provided the additional step "g1" of removing, rinsing, and utilizing said appliance.

20. The method of claim 18, wherein there is further provided in step "g" the additional step "g1" of varying the frequency of said sonic waves to enhance cleaning of the appliance.

21. The method of claim 1, wherein in step "d" only enough fluid to activate said cleaning tablet is placed into said bath tray, so that in step "g" said appliance is primarily contacted by said flavored foam, wherein in step "g" said appliance is substantially immersed in said foam bath.

* * * * *